US005325084A

United States Patent [19]

Timm et al.

[11] Patent Number: 5,325,084

[45] Date of Patent: Jun. 28, 1994

[54] SECURE AREA INGRESS/EGRESS CONTROL SYSTEM

[75] Inventors: Ronald E. Timm, Lemont; Glen Rasmussen, Elk Grove, both of Ill.

[73] Assignee: R. E. Timm & Associates, Hinsdale, Ill.

[21] Appl. No.: 865,377

[22] Filed: Apr. 8, 1992

[51] Int. Cl.[5] ..... G08B 13/00

[52] U.S. Cl. ..... 340/541; 49/31; 49/357; 49/506; 73/263; 73/264; 109/68; 340/825.31; 340/825.32

[58] Field of Search ..... 340/541, 540, 691, 825.31, 340/825.32; 109/68, 67, 64; 49/31, 357, 506; 70/263, 264, 262

[56] References Cited

U.S. PATENT DOCUMENTS

| | | | |
|---|---|---|---|
| 1,632,683 | 6/1927 | Tracy | 109/7 |
| 2,830,838 | 4/1958 | Drager | 70/262 |
| 4,481,887 | 11/1984 | Urbano | 109/3 |
| 4,539,555 | 9/1985 | Tefka | 49/31 |
| 4,643,106 | 2/1987 | Aragona | 109/6 |
| 4,652,862 | 3/1987 | Verslycken | 340/540 |
| 4,741,275 | 5/1968 | Lewiner et al. | 109/7 |
| 4,841,692 | 6/1989 | Coupard et al. | 52/3 |

*Primary Examiner*—Glen Swann, III
*Attorney, Agent, or Firm*—Laff, Whitesel, Conte & Saret

[57] ABSTRACT

The system includes a vestibule and a plurality of emergency exits interconnecting the secure area with the outside environment. The vestibule comprises a pair of security doors and the emergency exits comprise security doors having locking means and means for disabling the locking means in response to any one of several preselected egress corroborating events that are not likely to be associated with adversarial activity. The various preselected events may include non-emergency situations such as a request to leave or disable made by two persons within the secure area, a request to leave or disable made by a single person within the secure area plus security guard affirmation, and a request to leave or disable made by a single person within the secure area plus the expiration of a time delay triggered by the request. The various preselected events may also reflect emergency situations such as activation of an alarm system triggered by single, double or multiple alarms that bring into question the safety of insiders in the secure area. The emergency exits may be in the form of an environmentally-hardened portal or a single security door.

26 Claims, 3 Drawing Sheets

SECURE AREA INGRESS/EGRESS CONTROL SYSTEM

FIELD OF THE INVENTION

The present invention relates generally to systems for controlling the unauthorized ingress to and egress from a secure area. More particularly, the present invention relates to a unique system that both delays ingress to a secure area by persons having the unauthorized assistance of persons already within the secure area, and delays the unauthorized egress of persons within the secure area.

BACKGROUND OF THE INVENTION

Security systems which provide some degree of control of the ingress to and egress from enclosed or secure areas are known. Generally, there are two known approaches in such security systems. One approach is to physically harden the entry doors (and their associated hardware, i.e. locks and hinges) leading into the secure area. The objective is to increase the amount of time that it takes to penetrate the entry doors at least to that of the penetrability of the surfaces adjacent to the doors, i.e. the walls, ceiling, and floor. The rationale is to insure that doors which are provided for authorized ingress do not facilitate unauthorized entry by force.

The second approach comprises using doors adapted to be locked and unlocked by a mechanism responsive to a single event. For example, the event triggering the mechanism may be the turn of a key, the entry of a code, or the actuation of a switch by one having authority to lock and unlock the door, e.g. a security guard. Security effectiveness can be increased with "anti-passback" or "anti-piggyback" enhancements in the mechanism, whereby the mechanism unlocks the door in response to its recognition of credentials personal to authorized persons, such as weight or a personal key or code. A time delay may also be included so that the personal key or code cannot be used more than once during a specific time period.

In high security applications, the second approach is typically implemented using a "Two Person Rule". The Two Person Rule is based on the principle that insider adversarial activity is usually committed alone. Thus, when the Two Person Rule is implemented, a mechanism is provided for locking and unlocking the doors that can be activated only by two persons acting together, thereby significantly reducing the likelihood that the opening of the door is for adversarial purposes.

Doors used in accordance with the latter system may be part of a vestibule through which persons must pass in order to enter the secure area. By locking the doors to the vestibule, the vestibule can operate as a man trap in the event adversarial activity is suspected. For example, the vestibule may have a time delay that provides security personnel with time to examine an individual who seeks to leave the secure area. The time delay is triggered by the opening and closing of one of the doors, indicating that the individual seeking egress has entered the vestibule. Before the expiration of the time delay, however, the security person accesses the vestibule to view the individual or individuals and, among other things, to confirm that the correct number of individuals are present. If adversarial activity is suspected, the security person actuates an emergency switch or the like which locks the individual or individuals in the vestibule. Otherwise, upon expiration of the time delay, the other vestibule door opens, enabling the individual to leave.

Regardless of the type of security system used, there are always safety concerns regarding persons within the secure area who must be able to escape in the event of catastrophic events such as fires, explosions, etc. These safety concerns typically are addressed by providing secure entry doors with emergency panic opening features so that insiders may exit in the event of an emergency. Also, either in addition to or in lieu of panic opening features on secure entry doors, one or more separate emergency "panic opening" or "crash out" doors can be provided to allow insiders to exit at any time.

Although such panic opening doors are nearly foolproof in safeguarding the emergency escape of those in secure areas, they present a serious security risk. Where such panic opening doors are provided, the security system may be entirely defeated when an adversarial insider, who presumably is authorized to be within the secure area, opens the panic opening door to make an unauthorized exit or to admit an unauthorized person. Such insiders potentially include disgruntled employees, psychotics and criminals who have obtained authorization to be present in the secure area through fraud or deceit. Prior security systems fail to satisfactorily address this problem.

Accordingly, there is a need in the art for a security system that controls the ingress to and egress from a secure area, and that also addresses the problem of insider adversarial activity, all without impairing the ability of those in the secure area to escape when an by emergency arises.

BRIEF SUMMARY OF THE INVENTION

It is therefore an object of this invention to provide a security system that addresses adversarial activity committed by persons within a secure area.

It is a further object of this invention to provide a security system that significantly restricts the ability of an insider adversary to make an unauthorized exit or to assist outsider adversaries in entering the secure area.

It is a still further object of this invention to provide a security system that accomplishes the above objectives, without impairing the day-to-day safety of persons authorized to be present in the secure area.

In accordance with these objectives, a security system is provided for a secure area comprising a vestibule with two doors and a plurality of emergency exit doors. The two vestibule doors and all of the emergency exit doors are security doors having locking means and disabling means for unlocking or disabling the locking means upon the occurrence of any one of certain preselected events associated with nonadversarial activity inside the secure area. The preselected events include emergency and non-emergency events.

Preferably, the preselected non-emergency events comprise: (1) a request to leave (i.e. a request to activate the disabling means) made by two persons in the secure area (the Two Person Rule); (2) a request to leave (i.e. a request to activate the disabling means) made by a single person in the secure area accompanied by security guard affirmation; and (3) a request to leave (i.e. a request to activate the disabling means) made by a single person in the secure area upon expiration of a time delay triggered by the request. In the first case, in order to enable the person or persons wishing to leave to effect the request to activate the disabling means, at least two switches are provided, spaced apart a sufficient distance or ergonomically configured so that a single person is not able to activate two requests simultaneously.

In addition, particularly in the latter two cases, a communication system between the single person and the security guard may be included to allow a security guard to asses the bona fides of a request to leave by a single person after a single person request is made. After the security guard has assessed the bona fides of the request, the locking means can be disabled upon activation by the security guard of a remote switch. Also, when the locking means is to be disabled by the expiration of a time delay which is triggered by the single person request, the duration of the time delay is a function of the penetration hardness inherent in the door to ensure that the duration of the time delay is at least equal to the amount of time that it would take to penetrate the door.

One of the preselected emergency events is the activation of an alarm system sensitive to the outbreak of fire and any other hazardous events, such as, for example, the release of a specific hazardous chemical or radiation. To enhance the integrity of the system, the alarm system can comprise two or more spaced fire alarms, two or more sprinkler waterflow sensors, and/or two or more spaced alarms of the chosen sensitivity (i.e. fire, hazardous chemical, radiation, etc.), which come on only when a predetermined number of the individual alarms or sprinklers becomes activated.

Non-emergency, authorized entries and exits can be made through an inside vestibule through the use of a plurality of normal entry/exit switches. Preferably, the two vestibule security doors are interlocked so that neither door can open unless the other door is closed. To exit the secure area in a nonemergency situation, an authorized person actuates a normal entry/exit switch in the secure area through the use of an authorized pre-arranged entry method, such as entry of a code, thereby opening one of the vestibule security doors. Once inside the vestibule, the authorized person actuates a second normal entry/exit switch, again through the use of an authorized method such as entry of a code, thereby opening the second vestibule security door. Entry to the secure area through the vestibule is obtained in the reverse manner, by first actuating a normal entry/exit switch outside the second vestibule security door and then actuating a normal entry exit switch outside of the first vestibule security door. A contraband detection device may be provided in the vestibule so that the second switch is actuatable only after a person desiring to exit or enter the secure area satisfactorily moves past the contraband detection device.

The emergency exit may, if desired, comprise one or more environmentally-hardened portals constructed outside the secure area. Each portal comprises one of the above-described emergency exit doors separating the portal from the outside environment, and a second door having a crash-out or panic opening hardware separating the portal from the secure area. The second door is adapted to allow persons in the secure area to enter the portal during an emergency. Once inside the portal, persons are protected from catastrophic events such as fire or the like that has not, for whatever reason, activated the alarm system. Once the alarm system becomes activated, persons inside the portal can then exit through the emergency exit door.

BRIEF DESCRIPTION OF THE DRAWINGS

The foregoing invention and its advantages may be readily appreciated from the following detailed description of a preferred embodiment, when read in conjunction with the accompanying drawings in which.

DETAILED DESCRIPTION OF THE PREFERRED EMBODIMENTS

Figure 2:
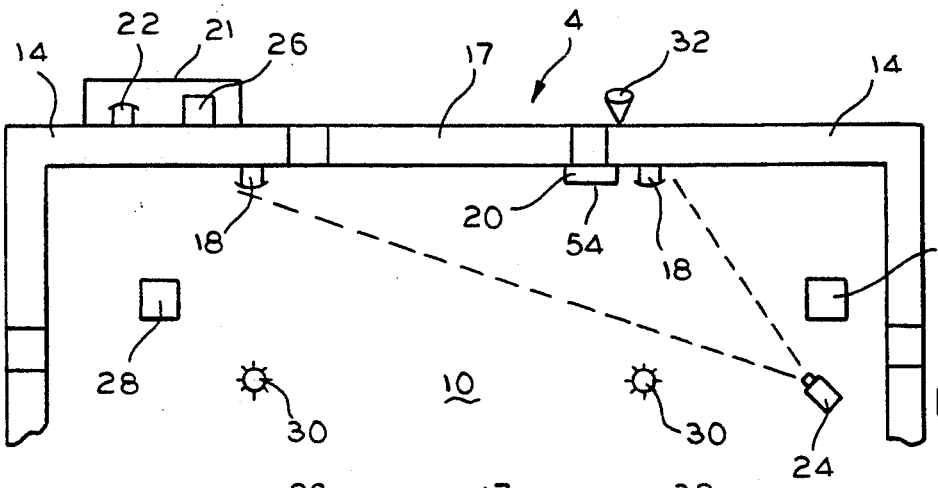
FIG. 2 is a partial schematic view of a secure area incorporating a security system in accordance with one embodiment of the invention, illustrating the secure area, a wall, and an emergency exit in the form of a security door separating the secure area from the outside environment, a security door locking device, and the various means, in the form of alarms, personnel exit switches and a communication system, used in disabling the security door locking device.
Figure 3:
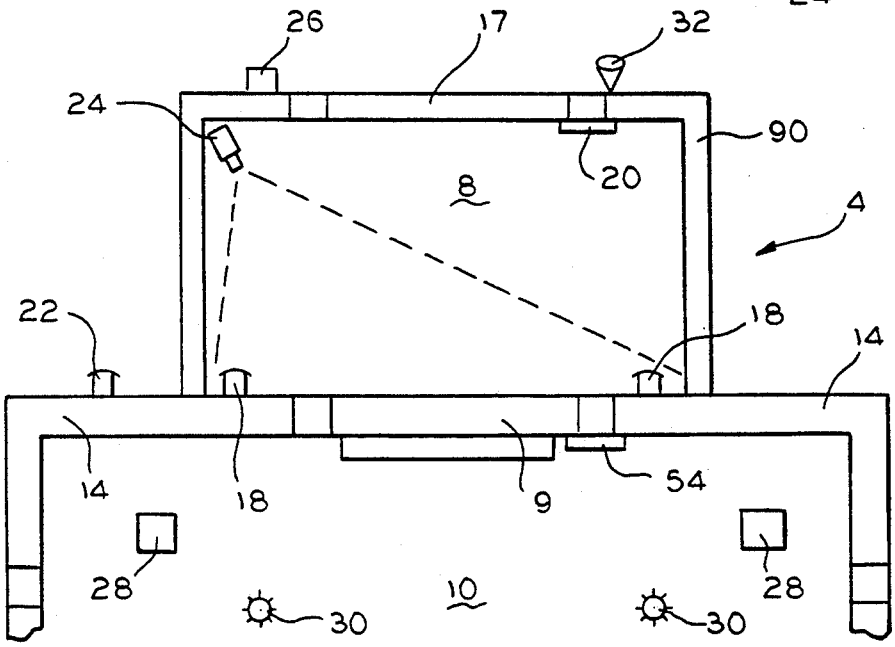
FIG. 3 is a partial schematic view of a secure area incorporating a security system in accordance with another embodiment of the invention, illustrating the secure area, a wall, an emergency exit in the form of a portal that interconnects the secure area to the outside environment, a security door, and a portal door, a security door locking device, and various means, in the form of alarms, personnel exit switches and a communication system, used in disabling the security door locking device.
Figure 1:
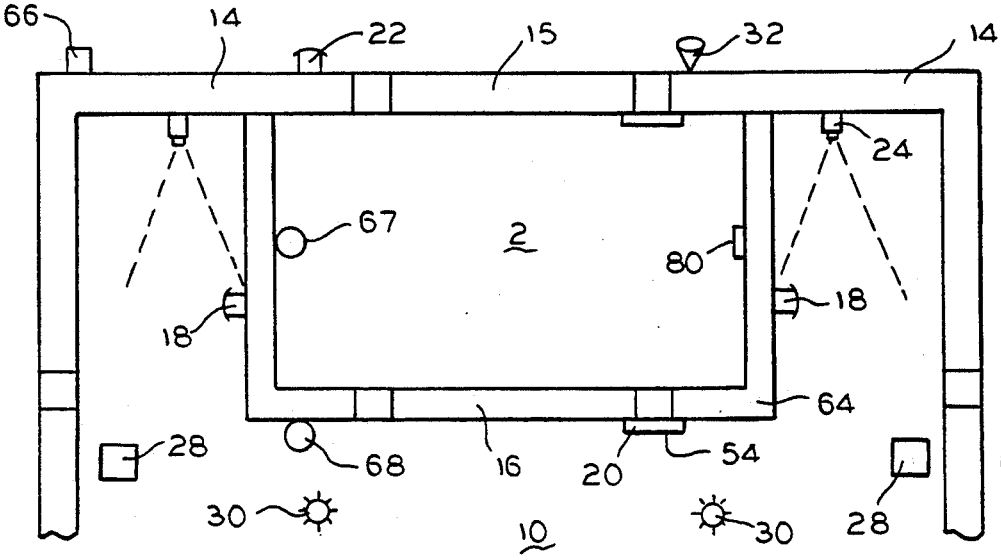
FIG. 1 is a partial schematic view of a secure area incorporating a security system in accordance with the invention, illustrating a secure area, a wall, a vestibule interconnecting the secure area to the outside environment, a pair of security doors, security door locking devices, and various means, in the form of alarms, personnel exit switches, and a communication system, used in disabling the security door locking devices.

A security system in accordance with this invention incorporates a vestibule 2 shown in FIG. 1 and a plurality of emergency exits 4 of the type shown in FIG. 2 or FIG. 3. The vestibule 2 and emergency exits 4 are incorporated in a secure area 10 that is separated from an outside environment by a wall 14. As hereinafter described, emergency and authorized nonemergency exits from the secure area can be made through vestibule 2 or emergency exits 4, and authorized nonemergency entries can be made through vestibule 2. The secure area may have any dimensions and may take on any configuration that serves to accommodate the valuable or sensitive items, information, technology, etc. which are being protected, and such persons authorized to be within the secured area.

As shown in FIG. 1, vestibule 2 comprises a pair of security doors 15, 16, and as shown in FIGS. 2 and 3, each emergency exit 4 comprises one security door 17. Each security door 15–17 has a locking device 20 that may be of any suitable type adapted to become disabled by means hereinafter described. Security door 15 separates the vestibule from outside environment and security door 16 separates the vestibule from secure area 10. Preferably, security doors 15, 16 are interlocked so that during a nonemergency entry or exit, neither security door 15, 16 can open unless the other security door 15, 16 is locked. Emergency exit 4 may be in the form of a single emergency security door 17, as shown in FIG. 2, or in the form of an environmentally-hardened portal 8 having one emergency security door 17 and a crash-out or panic opening door 9, as shown in FIG. 3. Desirably, wall 14 and security doors 15–17 are physically hardened to delay attempts by outsider adversaries to penetrate the area so that, if necessary, protective forces can respond in time to interrupt and neutralize the adversarial activity. Emergency security doors 17 are not designed to be opened from the outside.

Provided adjacent each security door 15–17 are at least two electric personnel exit switches 18 actuatable by persons in the secure area, part of an audio/video communication system 24, a time delay mechanism 26, a plurality of alarms 28, and a plurality of sprinklers 30. A remote electrical security switch 22 for each security door 15–17 actuatable by a security guard is located, preferably, outside the secure area 10 in a remote station 21. At least one grouping of security lights and horns 32 is provided on wall 14 near each security door 15–17 outside the secure area 10, and is adapted to become activated whenever any of the security doors is either opened or the exit switch 18 associated with that door is actuated. Personnel switches 18 may be located on opposite sides of each security door 15–17 and should be either spaced apart a sufficient distance or ergonomically designed so that the switches cannot be actuated simultaneously by a single person.

Communication system 24 is adapted to allow communication between persons actuating switches 18 and a security guard. Communication system 24 preferably comprises a camera located in secure area 10 near each switch 18, a closed circuit television located in remote station 21 and an audio system allowing communication between remote station 21 and persons who have actuated switch 18. The alarms 28 may be, e.g., fire, or hazardous chemical alarms. Sprinklers 30 may be heat sensitive or controlled by a releasing valve and associated control equipment.

Figure 4:
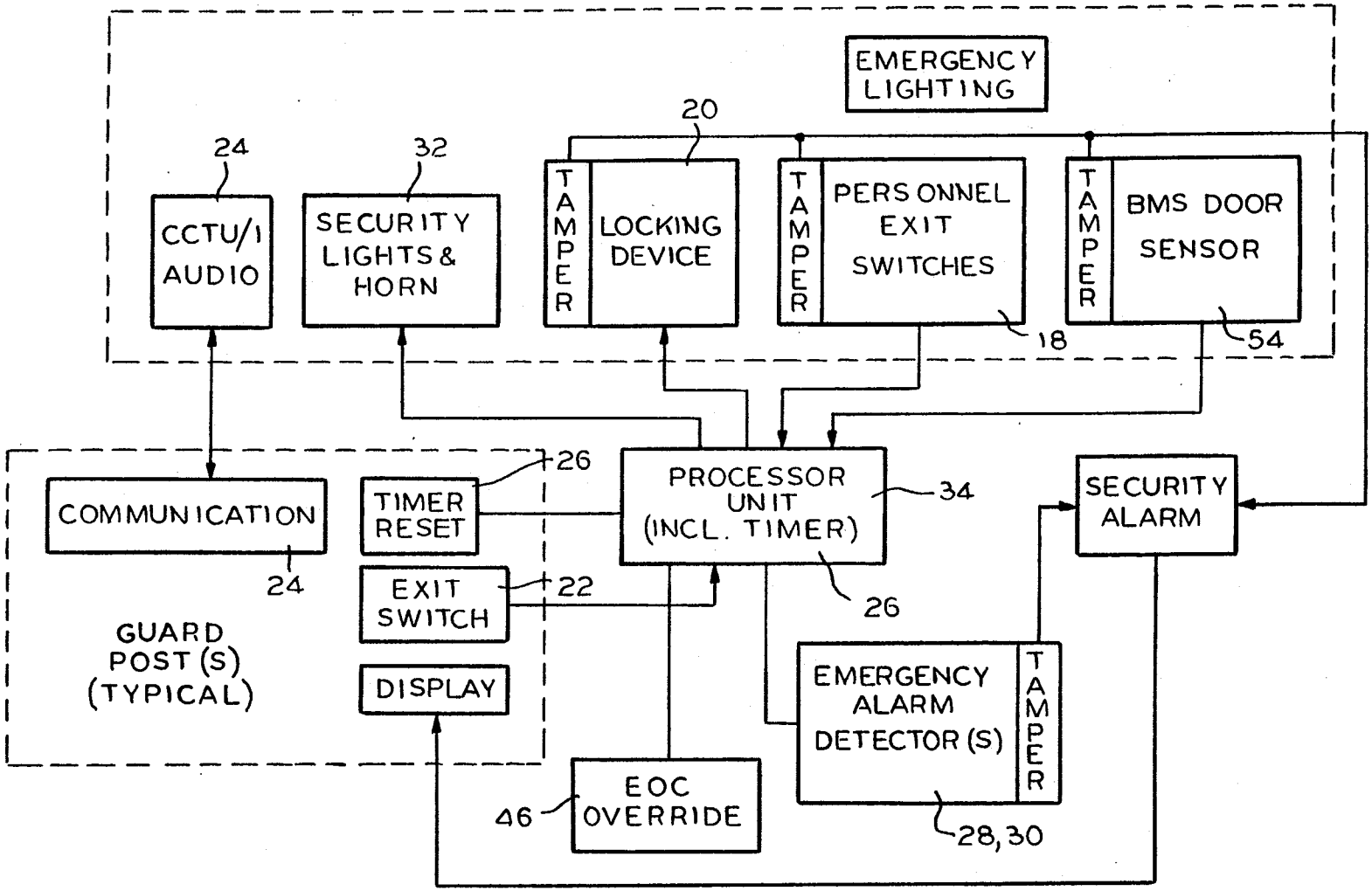
FIG. 4 is a block diagram of a control circuit of the disabling means of FIGS. 1–3.

A processor unit 34 is shown in the flow diagram of FIG. 4, electrically connected to locking device 20, personnel switches 18, remote security switch 22, time delay mechanism 26, alarm detectors 28, sprinklers 30, and security lights and horns 32. The processor unit 34 is adapted to disable the locking device 20 upon the occurrence of any one of various preselected events that are associated with insider activity, but that are not normally associated with adversarial activity. Control by the processor unit 34 of the locking device 20 can be implemented by using conventional relay logic, or conventional two out of three decision electronics designed to meet a prescribed stringent reliability criteria, or a microprocessor having firmware. The various preselected events may reflect either non-emergency or emergency events, as noted earlier.

The preselected non-emergency events recognizable by the processor unit 34, any one of which will effect disablement of the locking device 20, comprise, preferably: actuation of two personnel switches 18; actuation of one personnel switch 18 and remote security switch 22; and actuation of one personnel switch 18 plus expiration of time delay mechanism 26 which is triggered by the actuation of a personnel switch 18. These preselected events may vary, however, depending on the configuration of the secure area and the nature of what is being protected. For example, the number of personnel switches 18 which must be actuated before the locking means becomes disabled may, instead, be three or more, in order to increase the level of security.

Features may be provided in conjunction with the various event detecting hardware to increase the effectiveness of the system. For example, the time delay mechanism 26 preferably has a duration that corresponds to the penetration hardness of the wall 14 or security door 16, so that the duration of the delay will be at least equal to the time it would take an outsider to penetrate the wall or security door without the assistance of an insider.

The preselected emergency event recognized by the processor unit 34 comprises the activation of an alarm system, which may be effected in any number of ways. In the simplest embodiment, the alarm system may comprise one electronic fire alarm 28 or one sprinkler waterflow 30 and is triggered by the activation of the single alarm or sprinkler waterflow. However, if there is a need or desire to increase the effectiveness of the security system, the alarm may be arranged to trigger only after a predetermined number of alarms 28 or sprinklers 30 become activated, thereby making it more difficult for a single insider to activate the alarm system by tampering with a single alarm.

Figure 5:
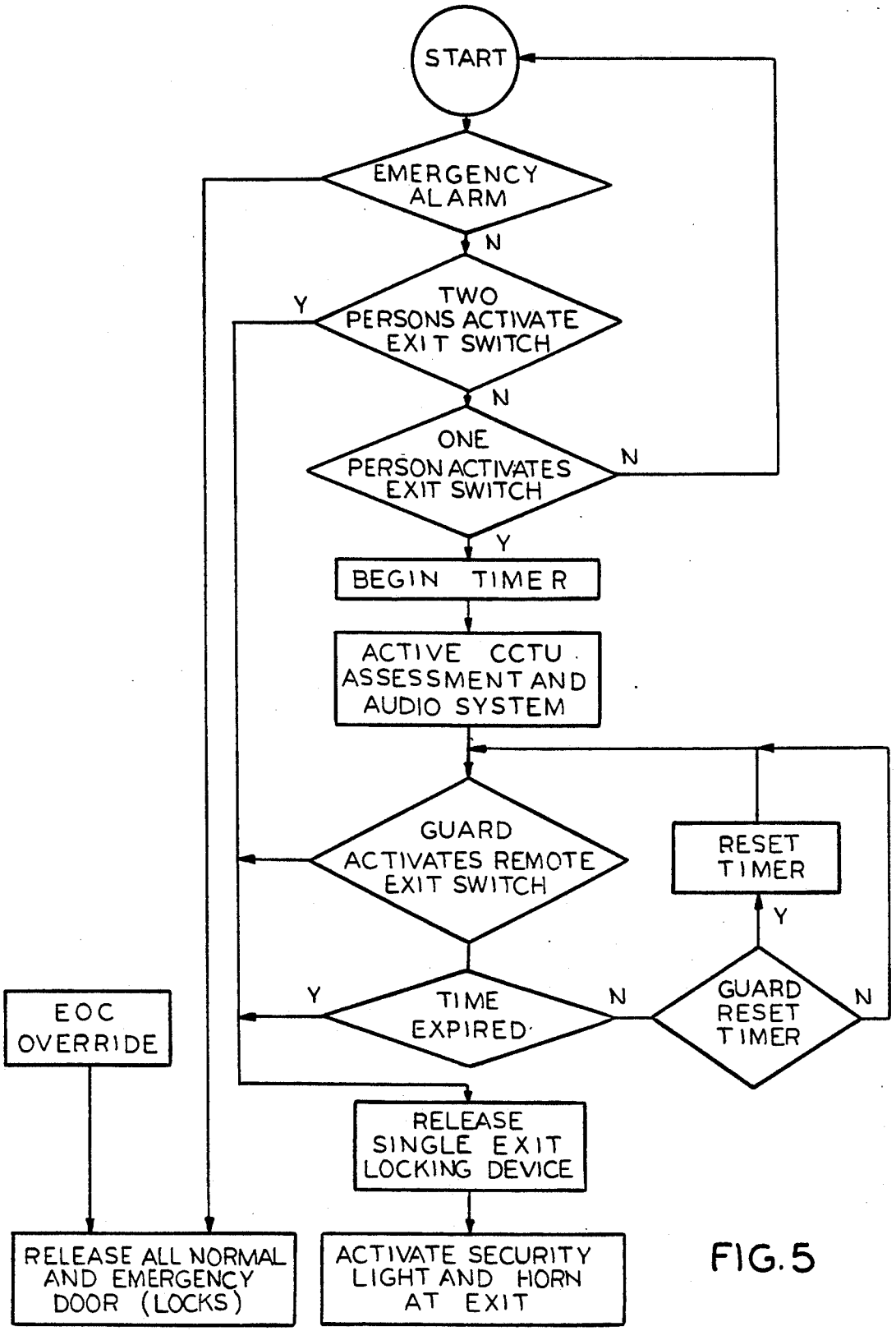
FIG. 5 is a flow diagram of the disabling means showing the steps of operation in accordance with the embodiments of FIGS. 1–3.

Accordingly, the manner of operation of the security system, which is best illustrated in the flow diagram of FIG. 5, is as follows: all security doors 15–17 are normally closed. An insider desiring to exit the secure area 10 through vestibule 2 or any of emergency exits 4 may do so with or without an insider companion. If there is an insider companion, the two insiders can at any time disable the locking device 20 by contemporaneously actuating two personnel switches 18.

If an insider desiring egress has no companion, the insider can attempt to leave by actuation of one personnel switch 18, which triggers the time delay mechanism 26 and informs the security guard that exit from the secure area is requested. Thereafter, the security guard can utilize the communication system 24 to assess whether the insider is attempting to commit adversarial activity. If the security guard concludes that there is no danger of adversarial activity, the security guard disables the locking device 20 by actuating remote security switch 22. Instead, the security guard can, if desired, reset the time delay mechanism 26 to provide the security guard additional time to assess the situation. The security guard may also allow the time setting of the time delay mechanism 26 to expire, which also will effect disablement of locking device 20. In any event, if a nonemergency exit is made through vestibule 2, interlocked security doors 15, 16 can consecutively open and close. Also, whenever any of the security doors 15–17 open or any switch 18 is actuated, regardless of which preselected event occurs, the security light and horn 32 become energized to alert security personnel to an individual's attempt to exit from the secure area.

Insider egress may also occur during an emergency. In the event the alarm system is triggered as described above, locking devices 20 become disabled, and all insiders are free to leave through any of the security doors 15–17. In the event an emergency exit is sought through portal 8, the insider must first open panic opening door 9. Once inside portal 8, because it is environmentally hardened, persons are safe from certain catastrophic events, such as fire, if, for whatever reason, security door 17 fails to open. Preferably, walls 90 of portals are constructed of bar grate to provide the environmental hardening.

In addition, if desired, a plurality of normal entry/exit switches 67, 68, 69 can be provided so that single person nonemergency, authorized entries to and exits from secure area 10 may be made at any time through vestibule 2. Normal exit/entry switches 66, 67, 68, are provided in vestibule 2, and on wall 14 in outside environment, as shown in FIGS. 1–3. Preferably, switches 66–68, are actuatable only through a specific entry method such as turning a key or entering a code. In addition, a contraband detection device 80 may be provided in vestibule 2. To enter secure area 10, switch 66 is actuated, thereby unlocking security door 15. Once inside the vestibule, the authorized person actuates switch 67 and, upon successfully passing the contraband detection device 80 (if included), security door 16 becomes unlocked. If desired, an authorized exit from secure area 10 can be made in the reverse manner by actuating switches 68, 67. In addition, anti-piggybacking and anti-passback enhancements can be provided at any of the switches 66–68, to increase the effectiveness of the system.

To further enhance the effectiveness of the system, balance magnetic switches 54 may also be included in the secure area 10, emergency security door 17, security door 16, doors to vestibule 2, or on panic opening door 9. The balance magnetic switches sense the opening of the door to which they are mounted and are electronically connected to remote a station, thereby alerting the security guard whenever an entrance or exit is being sought.

If desired, as shown in FIGS. 4 and 5, an emergency operation system 46 may be implemented during an ongoing emergency situation. It is adapted to be able to act as an override system and keep the locks either disengaged or engaged at all times, should circumstances warrant. For example, in the event of a true emergency outside the secure area 10, such as a fire, the emergency operation system 46 may be implemented to disengage all locks to allow unrestricted egress from the secure area. Or, in the event outsider adversarial activity is known to be occurring, the emergency operation system may be implemented to engage all locks and prevent or at least delay entry to the secure area.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. A security system for preventing unauthorized ingress to and egress from a secure area without impairing the safety of persons in the secure area comprising:

at least one security door leading out of the secure area to provide egress from the secure area, said at least one security door including means for locking said security door to prevent unauthorized opening thereof, an alarm system within the secure area, means at separated locations within the secure area for requesting activation of a disabling means, and means, associated with said locking means, for disabling said locking means in response to the occurrence of at least one of the following preselected events:

activation of said alarm system;

activation of said requesting means by two persons at separate locations within the secure area; and activation of said requesting means by a single person within the secure area plus a security guard affirmation.

2. The security system of claim 1 further comprising a time delay mechanism and said preselected events further comprising activation of said requesting means by a single person within the secure area plus expiration of said time delay mechanism.

3. The security system of claim 1 further comprising a vestibule and a plurality of security doors, one of said security doors separating said vestibule from said secure area and another of said security doors separating said vestibule from the environment outside of the vestibule.

4. The security system of claim 3 further comprising at least one emergency exit, said emergency exit having a corresponding one of said plurality of security doors.

5. The security system of claim 4 wherein said at least one emergency exit comprises a portal and a panic opening door separating said portal from said secure area, said corresponding one of said security doors separating said portal from the outside environment.

6. The security system of claim 1 wherein said alarm system comprises at least one fire alarm, said alarm system becoming activated by the activation of at least one fire alarm.

7. The security system of claim 1 wherein said alarm system comprises at least one fire alarm, at least one sprinkler, and at least one radiation alarm, said alarm system adapted to be triggered by the activation of any one of the following: said at least one fire alarm, said at least one sprinkler, and said at least one radiation alarm.

8. The security system of claim 1 wherein said alarm system comprises a plurality of spaced fire alarms, a plurality of spaced sprinklers, and a plurality of spaced radiation alarms, said alarm system adapted to be triggered by the activation of any one of the following: at least two fire alarms, at least two sprinklers, and at least two radiation alarms.

9. The security system of claim 1 wherein said alarm system comprises at least one fire alarm, at least one sprinkler, and at least one hazardous chemical alarm, said alarm system adapted to be triggered by the activation of any one of the following: said at least one fire alarm, said at least one sprinkler, and said at least one hazardous chemical alarm.

10. The security system of claim 1 wherein said alarm system comprises a plurality of spaced fire alarms, a plurality of spaced sprinklers, and a plurality of spaced hazardous chemical alarms, said alarm system adapted to be triggered by the activation of any one of the following: at least two fire alarms, at least two sprinklers, and at least two hazardous chemical alarms.

11. A security system for preventing unauthorized ingress to and egress from a secure area without impairing the safety of persons in the secure area comprising:

at least one security door leading out of the secure area to provide egress from the secure area, said at least one security door including means for locking said security door to prevent unauthorized opening thereof, means, associated with said locking means, for disabling said locking means in response to the occurrence of at least one of several preselected events, an alarm system within the secure area and, within the secure area, a plurality of spaced-apart electrical switches actuatable by persons in the secure area for requesting activation of said first disabling means, in which said preselected events comprise one or more of the following:

activation of said alarm system;

activation of said inside requesting means by two persons within the secure area; and activation of said inside requesting means by a single person within the secure area plus a security guard affirmation.

12. The security system of claim 11 further comprising a remote station and a means for communication between said remote station and persons actuating said switches, said communication means adapted to be used by a security guard in said remote station prior to providing said affirmation, and said communication means comprising a closed circuit television camera within the secure area, a closed circuit television in said remote station and an audio system.

13. The system of claim 12 further comprising an electrical switch actuatable by the security guard to effect said security guard affirmation.

14. The system of claim 13 wherein said disabling means comprises a processor unit electrically connected to said alarm system and said switches, said processor unit adapted to recognize the occurrence of said any one of said preselected events and adapted to activate said disabling means in response thereto.

15. A security system for delaying unauthorized ingress to and egress from a secure area without impairing the safety of persons in the secure area comprising:

a vestibule interconnecting the secure area with the outside environment;

a pair of security doors for passage between said vestibule and said outside environment, each of said security doors including locking means;

means, associated with each of said locking means, for disabling said locking means in response to at least one of several preselected events;

an alarm system within the secure area;

means within said vestibule for requesting activation of said disabling means; and a time delay;

in which the several preselected events comprise one or more of the following:

activation of said alarm system;

activation of said requesting means by two persons within the vestibule;

activation of said requesting means by a single person within the vestibule plus a security guard affirmation; and activation of said requesting means by a single person within the vestibule plus expiration of said time delay.

16. The security system of claim 15 further comprising:

at least one second door for emergency exit to the outside environment, said second security door including second locking means; and means associated with said second locking means, for disabling said first-recited locking means in response to at least one of several second preselected events.

17. The security system of claim 16 further comprising means within said secure area for requesting actuation of said second disabling means and a second time delay, in which said several second preselected events comprise activation of one or more of the following:

said alarm system;

said second requesting means by two persons within said secure area;

said second requesting means by a single person within said secure area plus a security guard affirmation; and said second requesting means by a single person within said secure area plus expiration of said second time delay.

18. The security system of claim 17 further comprising an environmentally-hardened portal interconnecting the secure area with the outside environment, said portal having a panic opening door separating said portal from said secure area, said at least one second security door separating said portal from the outside environment.

19. A security system for delaying unauthorized ingress to and egress from a secure area without impairing the safety of persons in the secure area comprising:

a vestibule interconnecting the secure area with the outside environment;

a pair of first security doors for passage between said vestibule and said outside environment, each of said first security doors including first locking means;

means, associated with each of said first locking means, for disabling said first locking means in response to at least one of several first preselected events;

an alarm system within the secure area;

first means within said vestibule for requesting activation of said first disabling means; and a first time delay;

in which said several first preselected events comprise one or more of the following:

activation of said alarm system, activation of said first requesting means by two persons within the vestibule, activation of said requesting means by a single person within the vestibule plus a security guard affirmation, and activation of said first requesting means by a single person within the vestibule plus expiration of said first time delay, at least one second security door for emergency exit to the outside environment, said second security door including second locking means;

means, associated with said second locking means, for disabling said first locking means in response to at least one of several second preselected events; and means within said secure area for requesting actuation of said second disabling means and a second time delay, in which said several second preselected events comprise activation of one or more of the following:

said alarm system, said second requesting means by two persons within said secure area, said second requesting means by a single person within said secure area plus a security guard affirmation, and said second requesting means by a single person within said secure area plus expiration of said second time delay, wherein said first-recited and second-recited requesting means comprise a plurality of spaced-apart electrical switches actuatable by persons in said secure area.

20. The security system of claim 19 further comprising a remote station and means for communication between a security guard in said remote station and persons actuating said switches, said communication means adapted to be used by the security guard prior to providing said affirmation, and said communication means comprising a closed circuit television camera within the secure area, a closed circuit television in said remote station, and an audio system.

21. The security system of claim 20 further comprising a balanced magnetic switch mounted to one of said first-recited security doors and said at least one second security door.

22. The system of claim 21 wherein said first-recited and second-recited disabling means comprise a processor unit electrically connected to said alarm system and said switches, said processor unit adapted to recognize the occurrence of said any one of said pre-selected events and adapted to activate said first-recited disabling means in response thereto.

23. The security system of claim 22 further comprising means for making an authorized exit from said secure area through said vestibule and means for making an authorized entry to said secure area through said vestibule.

24. The security system of claim 23 wherein said authorized exit means and said authorized entry means comprise a plurality of security switches and wherein said first-recited and second-recited doors are interlocked so that during an entry or exit neither door can be unlocked unless the other door is locked, a first of said security switches being located in said secure area and adapted upon actuation to unlock said first-recited door, a second of said security switches being located in said vestibule and adapted upon actuation to unlock said second door after said first switch has been actuated and to unlock said first door after a third switch has been actuated, and a third of said security switches being located in the outside environment and being adapted upon actuation to unlock said second door.

25. The security system of claim 24 further comprising a contraband detection device located in said vestibule, said second security switches actuatable only after a person inside said vestibule has successfully passed said contraband detection device.

26. A method of preventing unauthorized ingress to a secure area having at least one inner security door opening into a vestibule having at least one outer security door by persons having the unauthorized assistance of persons within the secure area and of preventing unauthorized egress of persons within the secure area while permitting an authorized person ingress, said method comprising the steps of:

a person in the outside environment actuating a first entry switch located in the outside environment;

opening said outer security door in response to the actuation of said first entry switch to admit said person;

closing said outer security door;

said person actuating a second entry switch located in said vestibule;

assessing the bonafides of said person by both a person within the secure area and a person at a different location through the use of a communication system; and opening said at least one inner security door in response to substantially simultaneous actuation of separate means by both the person within the secure area and the person at a different location if said person is an authorized person.

* * * * *